US006511162B1

(12) United States Patent
Kashino et al.

(10) Patent No.: US 6,511,162 B1
(45) Date of Patent: Jan. 28, 2003

(54) LIQUID DISCHARGE HEAD AND METHOD FOR MANUFACTURING THE SAME

(75) Inventors: Toshio Kashino, Fujisawa; Hiroshi Sugitani, Machida; Masami Ikeda, Tokyo; Yoshiaki Suzuki, Yokohama; Shuji Koyama, Kawasaki; Masashi Miyagawa, Yokohama; Hiroaki Mihara, Musashino; Takashi Saito, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 09/608,167

(22) Filed: Jun. 30, 2000

(30) Foreign Application Priority Data

Jul. 2, 1999 (JP) ..... 11-189625

(51) Int. Cl.[7] ..... B41J 2/045
(52) U.S. Cl. ..... 347/71
(58) Field of Search ..... 347/71, 70, 63–65, 347/56, 59, 54, 20, 88, 100, 17, 96, 98, 40, 43, 47, 67–68, 69; 29/890.1; 216/27

(56) References Cited

U.S. PATENT DOCUMENTS 4,317,124 A * 2/1982 Shirato ..... 347/67
4,380,018 A * 4/1983 Andoh ..... 347/68
4,480,259 A * 10/1984 Kruger et al. ..... 347/63
5,278,585 A * 1/1994 Karz et al. ..... 347/65
5,852,456 A * 12/1998 Okada et al. ..... 347/71
5,933,170 A * 8/1999 Takeuchi et al. ..... 347/71
6,010,209 A * 1/2000 Kitahara ..... 347/71
6,325,493 B1 * 12/2001 Yamaguchi ..... 347/65

* cited by examiner

*Primary Examiner*—N. Le
*Assistant Examiner*—K. Feggins
(74) *Attorney, Agent, or Firm*—Fitzpatrick, Cella, Harper & Scinto

(57) ABSTRACT

In a liquid discharge head having a head body provided with an orifice plate having a plurality of discharge ports for discharging liquid droplets therefrom, a plurality of flow paths communicating with respective ones of the plurality of discharge ports, a liquid chamber for supplying liquid to the plurality of flow paths, and a plurality of energy generating elements disposed correspondingly to the plurality of flow paths and generating energy for discharging the liquid droplets, the orifice plate being joined to the joined surface of the head body in which the communication ports of the flow paths communicating with the discharge ports of the orifice plate are disposed, the orifice plate comprises a first member providing the core of the orifice plate and formed with apertures layer than the discharge ports at locations whereat the discharge ports are formed, and a second member covering the both surfaces of the first member and the inner surfaces of the apertures.

126 Claims, 11 Drawing Sheets

LIQUID DISCHARGE HEAD AND METHOD FOR MANUFACTURING THE SAME

BACKGROUND OF THE INVENTION

Field of the Invention and Related Art

This invention relates to a liquid discharge head for injecting liquid and forming flying liquid droplets to thereby effect recording, and a method of manufacturing the liquid discharge head. Also, the present invention is an invention which can be applied apparatuses such as a printer for effecting recording on a recording medium such as paper, yarn, fiber, cloth, leather, metals, plastics, glass, wood or ceramics, a copier, a facsimile apparatus having a communication system, and a word processor having a printer, and further an industrial recording apparatus compositely combined with various processing apparatuses.

The term "recording" in the present invention means not only imparting meaningful images such as characters and figures to a recording medium, but also imparting meaningless images such as patterns to a recording medium.

An ink jet recording apparatus for discharging recording liquid (ink) from the orifices of a liquid discharge head to thereby effect recording is known as a recording apparatus excellent in such points as low moise and high-speed recording.

With regard to this ink jet recording method, various systems have heretofore been proposed and improved, and some of them have been commercialized and some of them continue to be subjected to the effort to put them into practical use.

The liquid discharge head of this kind, as shown, for example, in FIG. 10 of the accompanying drawings, is comprised of an orifice plate 1040 having orifices 1041 for discharging ink, a top plate 1400 for forming flow paths 1401 communicating with the respective orifices, and a substrate 1100 having energy generating elements 1101 (hereinafter referred to as the heaters) constituting a part of the flow paths and generating energy for discharge.

The orifice plate 1040 has minute orifices 1041 for discharging the ink, and these orifices are important elements governing the discharging performance of the liquid discharge head. That is, such advantages as good workability and good ink resistance, because of the direct contact with the ink, are required of the orifice plate 1040 of the liquid discharge head because the minute orifices 1041 are formed therein.

As a material satisfying the above-mentioned advantages, use has heretofore been made of a metal plate such as SUS, Ni, Cr or Al, or a resin film material such as polyimide, polysulfone, polyether sulfone, polyphenylene oxide, polyphenylene sulfide or polypropylene which can be obtained easily and inexpensively.

On the other hand, with the recent advance of the recording technique, high-speed and highly minute recording is coming to be required and therefore, the orifices 1041 have become minute in the size (orifice diameter) thereof and have come to be formed highly densely. As the result, various contrivances have been made in the method of working the orifices 1041, and when resin film is used, a laser beam is suited for minute working and therefore, a laser beam is used for the orifice working of the resin film. Also, when a metal plate is used, the orifices 1041 are formed by a method such as electrocasting.

However, it is very difficult to join the orifice plate 1040 formed with the minute orifices and the flow paths 1401 corresponding thereto together without any gap with respect to the adjacent orifices 1041.

Therefore, there have been adopted a method of joining resin film as the material of an orifice plate to a head body, and thereafter orifice-working it, as disclosed in Japanese Patent Application Laid-Open No. 2-187342, etc., and a method of using dry film or the like as an orifice plate, bringing it in its softened state by heating into pressure contact with the joined surface of a head body, bringing the softened orifice plate into flow paths, and thereafter working orifices by the photolithography process or laser working, as disclosed in Japanese Patent Application Laid-Open No. 2-204048, etc.

It is desirable that the shape of the orifices of a liquid discharge head be a so-called tapered shape in which the diameter thereof becomes smaller from the flow path side toward the discharge port side, but if after the orifices of the tapered shape are formed in the orifice plate, adhesive resin is applied by a transferring method or the like and is hardened with the orifice plate stuck, there occurs the inconvenience that the adhesive resin goes into the orifices and the shape of the orifices formed in the tapered shape is changed and irregularity arises in the discharging direction. Also, the entry of a bubble due to bad close contact makes the adhesion to the adjacent orifices insufficient and causes bad discharge.

Therefore, there has also been adopted a method of providing a level difference near orifices so that adhesive resin may not go into flow paths and orifices, as disclosed in Japanese Patent Application Laid-Open No. 5-330061, etc.

Also, when the orifice plate formed with the orifices is to be adhesively secured to the joined surface of the head body, positional deviation during hardening occurs due to the hardening and contraction of the adhesive resin. Therefore, as disclosed in Japanese Patent Application Laid-Open No. 2-78560, etc., a method of forming unevenness on the joined surface of an orifice plate is also adopted in order to prevent the influence of the hardening and contraction of the material used for joint.

Also, as a method of manufacturing a liquid discharge head body to be joined to such an orifice plate, there is, for example, the following method. Discharge energy generating elements are first formed on a silicon substrate, and then photosensitive resin forming flow path walls is laminated. Thereafter, the photosensitive resin is patterned to thereby form desired flow path walls. After the flow path walls have been formed, a top plate formed of glass or the like is layered, and flow paths are formed. Further, the layered body is cut by a diamond blade or the like, whereby the adjustment and separation of the length of the flow paths are effected. Then, the orifice plate is joined through an adhesive agent or the like so as to communicate with the flow paths, and a desired liquid discharge head is manufactured.

FIG. 11 of the accompanying drawings is a perspective view showing another example of the liquid discharge head according to the prior art, and FIG. 12 of the accompanying drawing is a plan view thereof. The liquid discharge head shown in FIGS. 11 and 12 has flow path walls 1301 and electrothermal conversion elements 1303 as discharge energy generating elements provided on a silicon substrate 1309, and a top plate 1310 comprising, for example, a silicon substrate is joined thereto. An orifice plate 1307 cut by the use of a diamond blade in order to adjust the positions of flow paths 1302, and provided with orifices 1308 is joined to the top plate by an adhesive agent such as epoxy resin.

Again such a liquid discharge head has suffered from the problem that the adhesive agent used when the orifice plate is joined goes into and clogs in the flow paths. Therefore, again here, as described in Japanese Patent Application Laid-Open No. 5-330061, there is adopted a method of providing a level difference near the orifices to thereby prevent the entry of the adhesive agent into the flow paths and the orifices.

However, the prior art described above has suffered from various problems as discussed below.

A first problem is the problem that when the orifice plate is formed of resin or a metal such as stainless steel, the pitch deviates by the heating of the orifice plate and the head body during adhesion due to the difference between the coefficients of thermal expansion of the two and therefore, a load enough to suppress this deviation of the pitch must be applied, and this leads to the bulkiness of a manufacturing apparatus and the necessity of extending the production tact. Also, still after the orifice plate has been joined to the head body, expansion and contraction are repeated by the temperature rise during printing or a temperature change during transportation and therefore, particularly in a long head exceeding an inch, there is the possibility of the distortion or peeling of the orifice plate occurring. Thus, the difference between the coefficients of thermal expansion of the orifice plate and the head body has been a great problem in the development of products.

A second problem is the problem that if the mechanical strength of the orifice plate is low, the difficulty of handling in the assembling of the head is high and the influence imparted to the cost of the apparatus in terms of the production technology is great. In contrast, if use is made of a metal such as iron or a nickel alloy having a small coefficient of thermal expansion and high mechanical strength (for example, 42 invar of iron:nickel of 58:42, or 36 invar of iron:nickel of 64:36), the thermal problem and the problem of the mechanical strength can be solved, but these metals are weak in ink resistance and have the possibility of being corroded by ink. So, a method of plating the surface of the orifice plate with a metal of high corrosion resistance such as gold or palladium would occur to mind, but this methods results in higher costs and besides, has the possibility of corrosion progressing from a slight pinhole in the plating, and this leads to the problem in reliability.

SUMMARY OF THE INVENTION

So, the present invention has as its object to provide a liquid discharge head in which the difference in thermal expansion between an orifice plate and a head body can be suppressed and the mechanical strength and ink resistance of the orifice plate can be enhanced, and a method of manufacturing the liquid discharge head.

To achieve the above object, the liquid discharge head of the present invention is a liquid discharge head having a head body provided with an orifice plate having a plurality of discharge ports for discharging liquid droplets therefrom, a plurality of flow paths communicating with respective ones of the plurality of discharge ports, a liquid chamber for supplying liquid to the plurality of flow paths, and a plurality of energy generating elements disposed correspondingly to the plurality of flow paths and generating energy for discharging the liquid droplets, the orifice plate being joined to the joined surface of the head body in which the communication ports of the flow paths communicating with the discharge ports of the orifice plate are disposed, characterized in that the orifice plate comprises a first member providing the core of the orifice plate and formed with apertures larger than the discharge ports at locations whereat the discharge ports are formed, and a second member covering the both surfaces of the first member and the inner surfaces of the apertures.

According to the liquid discharge head of the present invention constructed as described above, it becomes possible to lower the coefficient of linear expansion of the orifice plate and enhance the mechanical strength of the orifice plate by the first member and to enhance the ink resistance of the orifice plate by the second member. Therefore, the possibility of the distortion or peeling of the orifice plate by the thermal expansion thereof being caused is reduced and also the corrosion thereof by ink is prevented and thus, the reliability of the liquid discharge head is improved.

Further, by adopting a construction in which the coefficient of linear expansion of the first member is substantially equal to the coefficient of linear expansion of the head body, the possibility of the distortion or peeling of the orifice plate being caused by the difference in thermal expansion between the orifice plate and the head body is more reduced.

Furthermore, a construction in which the coefficient of linear expansion of the first member and the coefficient of linear expansion of the second member are equal to each other or the coefficient of linear expansion of the first member is smaller than the coefficient of linear expansion of the second member may be adopted, and a construction in which the first member and the second member are equal to each other in at least one of elastic modulus and Young's modulus or the first member is higher in at least one of elastic modulus and Young's modulus than the second member may be adopted. Thereby, the possibility of the first member and the second member being peeled and the second member being cracked by the difference in thermal expansion or the difference in distortion between the first member and the second member is reduced.

Further, a construction in which the first member is formed of a metal and the second member is formed of resin may be adopted.

Also, a construction in which the discharge ports are formed by perforating the second member aiming at the apertures of the first member relative to an orifice plate precursor in which the both surfaces of the first member are covered with the second member and the apertures of the first member are filled with the second member may be adopted.

Further, a construction in which the apertures of the first member are formed by etching, press working, laser working or electroforming may be adopted.

Also, the liquid discharge head of the present invention is a liquid discharge head having a head body provided with an orifice plate having a plurality of discharge ports for discharging liquid droplets therefrom, a plurality of flow paths communicating with respective ones of the plurality of discharge ports, a liquid chamber for supplying liquid to the plurality of flow paths, and a plurality of energy generating elements disposed correspondingly to the plurality of flow paths and generating energy for discharging the liquid droplets, the orifice plate being joined to the joined surface of the head body in which the communication ports of the flow paths communicating with the discharge ports of the orifice plate are disposed, characterized in that the orifice plate comprises a discharge port forming area and a reinforcing area, and in the reinforcing area, the interior of the orifice plate is filled with a reinforcing member.

Also, a construction in which the orifice plate and the head body are joined together by an adhesive agent may be adopted.

Further, a construction in which the adhesive agent comprises resin made into B stage by the application of ultraviolet rays, the application of infrared rays or the heating process may be adopted, or a construction in which the adhesive agent comprises epoxy resin having at least one of the thermosetting property and the light energy hardening property may be adopted.

Furthermore, a construction in which an adhesive agent layer comprising the adhesive agent is formed on that surface of the orifice plate which is joined to the head body may be adopted.

Also, by adopting a construction in which a joint auxiliary member deformable by the joining of the orifice plate and the head body to seal the surroundings of the communication ports is provided between the orifice plate and the end surface of the head body, the joint auxiliary member is deformed, whereby the orifice plate is joined in closer contact with the head body.

Further, a construction in which an adhesive agent layer comprising the adhesive agent is formed on the surface of the joint auxiliary member may be adopted.

Further, a construction in which an ink-repelling layer is formed on that surface of the orifice plate which is opposite to the surface thereof joined to the head body may be adopted.

The method of manufacturing a liquid discharge head of the present invention is a method of manufacturing a liquid discharge head having a head body provided with an orifice plate having a plurality of discharge ports for discharging liquid droplets therefrom, a plurality of flow paths communicating with respective ones of the plurality of discharge ports, a liquid chamber for supplying liquid to the plurality of flow paths, and a plurality of energy generating elements disposed correspondingly to the plurality of flow paths and generating energy for discharging the liquid droplets, the orifice plate being joined to the joined surface of the head body in which the communication ports of the flow paths communicating with the discharge ports of the orifice plate are disposed, characterized by the step of forming the orifice plate by the step of forming apertures larger than the discharge ports at locations in a first member providing the core of the orifice plate whereat the discharge ports are formed, the step of covering the both surfaces of the first member with a second member and filling the apertures of the first member with the second member, and the step of perforating the second member aiming at the apertures of the first member to thereby form the discharge ports.

According to the method of manufacturing a liquid discharge head of the present invention, there is manufactured a liquid discharge head in which the possibility of the distortion or peeling of the orifice plate by the thermal expansion thereof being caused is reduced and the corrosion of the orifice plate by ink is prevented and reliability is enhanced.

Further, a construction having the step of forming an adhesive agent layer on that surface of the second member which is to be joined to the head body, after the step of covering the both surfaces of the first member with the second member and filling the apertures of the first member with the second member may be adopted.

Furthermore, a construction having the step of forming an ink-repelling layer on the surface opposite to that surface of the second member which is to be joined to the head body, after the step of covering the both surfaces of the first member with the second member and filling the apertures of the first member with the second member may be adopted.

DESCRIPTION OF THE PREFERRED EMBODIMENTS

Some embodiments of the present invention will hereinafter be described with reference to the drawings.

Figure 1:
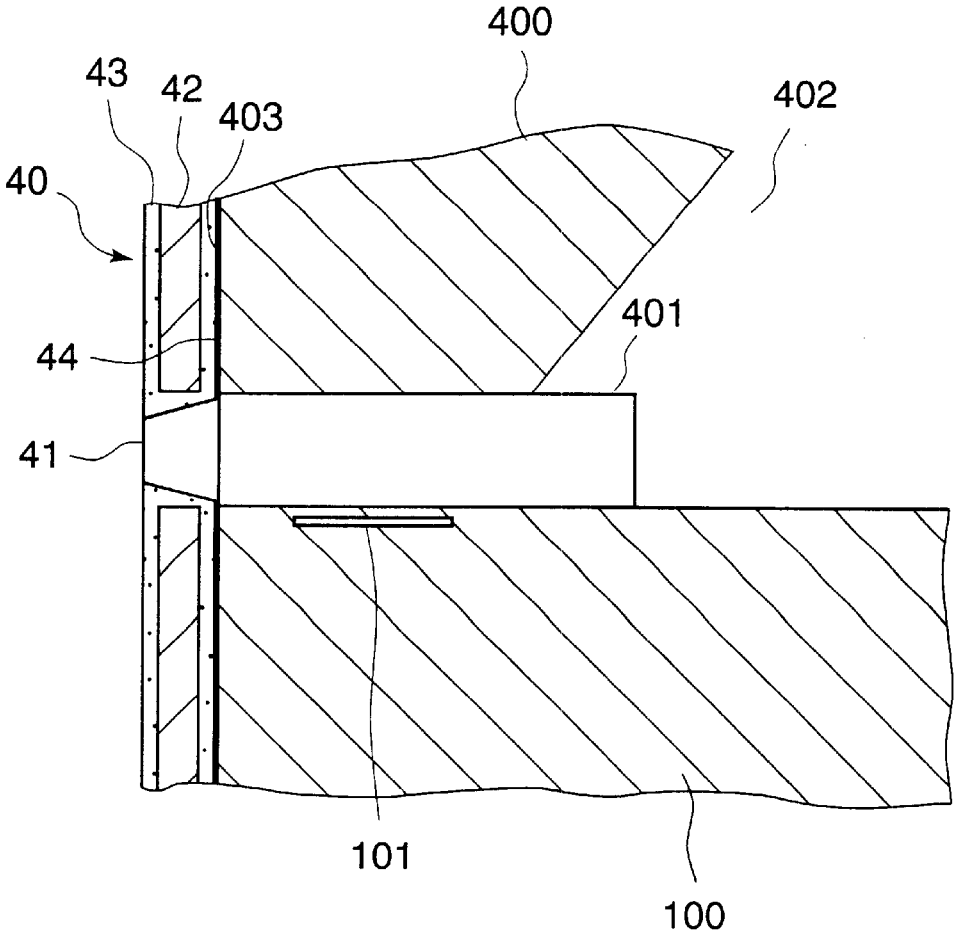
FIG. 1 is a typical cross-sectional view showing an embodiment of the liquid discharge head of the present invention.
Figure 2:
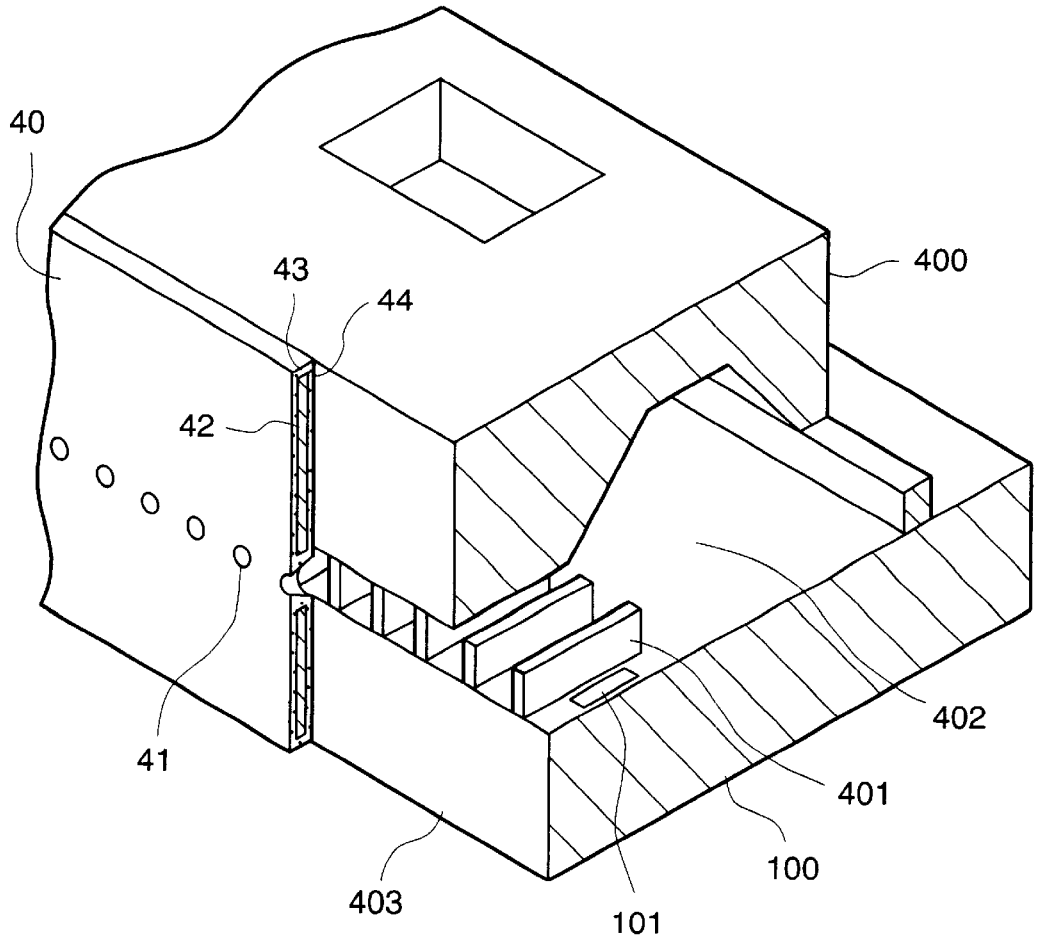
FIG. 2 is a typical perspective view showing an embodiment of the liquid discharge head of the present invention.

FIG. 1 is a typical cross-sectional view showing an embodiment of the liquid discharge head of the present invention, and FIG. 2 is a typical perspective view showing an embodiment of the liquid discharge head of the present invention.

As shown in FIGS. 1 and 2, the liquid discharge head of the present embodiment is provided with a head body constituted by a top plate 400 integrally formed with a level difference for constituting a liquid chamber 402, and a base plate 100 having energy generating elements (hereinafter referred to as the "heaters") 101 for generating discharging energy and Al wiring for supplying an electrical signal thereto formed on an Si substrate by a film forming technique, and formed with flow path walls 401 constituting ink flow paths correspondingly to the respective heaters, the top plate 400 and the base plate 100 being joined together. By this joining, an orifice plate 40 is stuck on an opening disposing surface (hereinafter referred to as the "head body joint surface") 403 in which the openings (communication ports) of the flow paths 401 formed in each unit are disposed.

The orifice plate 40 is comprised of a first member 42 which is formed with a plurality of apertures and provides the core of the orifice plate 40, and a second member 43 covering the first member 42, and discharge ports 41 are formed by boring the second member 43 filling the apertures of the first member 42.

In the present embodiment, 42 invar of iron:nickel of 58:42 having a thickness of 20 $\mu$m is used as the first member 42, and epoxy resin is used as the second member 43. The opposite surfaces of the first member 42 are covered with epoxy resin as the second member 43, whereby an orifice plate precursor having a thickness of 50 μm is once formed.

By adopting a construction in which as in the present embodiment, the first member 42 as a core formed of a metal of low thermal expansion is covered with the second member 43 formed of resin and the coefficients of linear thermal expansion of the orifice plate 40 and the head body are substantially equal to each other, the pitch deviation of the discharge ports 41 by thermal expansion during the step of working the orifice plate 40 and during the step of assembling the liquid discharge head can be prevented. Further, when the liquid discharge head is a so-called long head, the reliability of the liquid discharge head from the viewpoint of heat resistance can be markedly enhanced.

Also, by using the first member 42 formed of a metal, the mechanical strength of the orifice plate 40 can be enhanced. Further, since the apertures and surfaces of the first member 42 are covered with resin, it never happens that the first member 42 formed of a metal directly contacts with ink. Therefore, according to the present embodiment, it is also possible to prevent the corrosion of the orifice plate 40 by the ink.

Further, it is preferable that the coefficient of linear expansion of the first member 42 be equal to or smaller than the coefficient of linear expansion of the second member 43. Also, it is preferable that the first member 42 and the second member 43 be equal in at least one of elastic modulus and Young's modulus or the first member 42 be higher in at least one of elastic modulus and Young's modulus than the second member 43. Thereby, it is possible to reduce the possibility that the first member 42 and the second member 43 peel off or a crack is created in the second member 43 due to the thermal expansion difference between or the distortion of the first member 42 and the second member 43.

Also, for the working of the first member 42 formed of a metal, the working technique such as press, a laser, etching or electroforming which can accomplish mass production can be used, and further, by using liquid resin as the second member 43 which is the cover resin, inexpensive and highly reliable orifice plates 40 can be mass-produced.

(First Embodiment)

FIGS. 3A to 3D are cross-sectional views showing the process of manufacturing an orifice plate in a first embodiment of the liquid discharge head of the present invention.

Figure 3A:
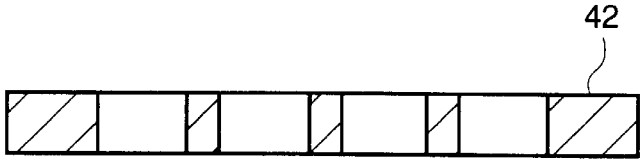
FIGS. 3A, 3B, 3C and 3D are cross-sectional views showing the process of manufacturing an orifice plate in a first embodiment of the liquid discharge head of the present invention.
Figure 4:
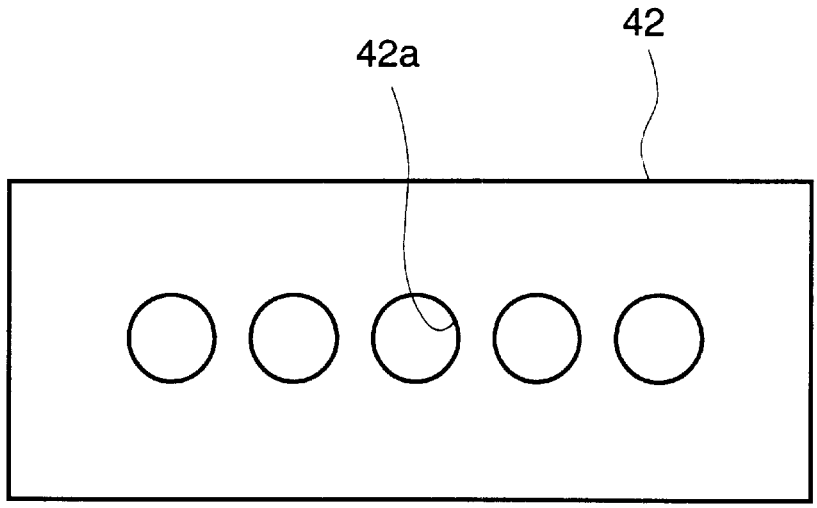
FIG. 4 is a plan view of a first member shown in FIG. 3A.

In the process of manufacturing the orifice plate 40 in the present embodiment, as shown in FIGS. 3A and 4, 1340 round apertures 42*a* having a pitch of 70.5 μm and an aperture diameter of 45 μm were first formed in the first member 42 formed of 42 invar and having a thickness of 30 μm by press working FIG. 4 is a plan view of the first member shown in FIG. 3A.

Figure 3B:
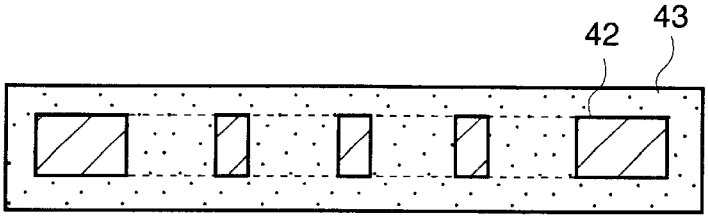
Figure 3C:
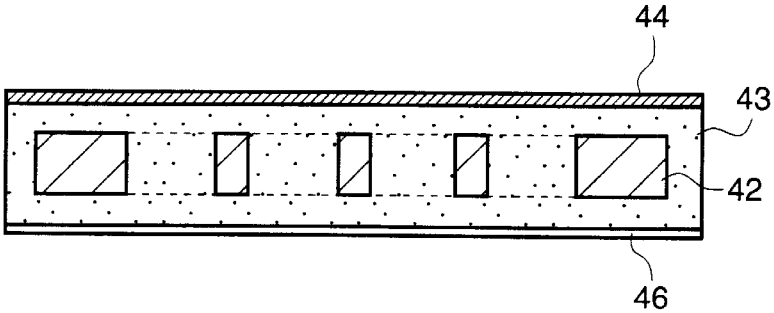

Next, as shown in FIG. 3B, the surfaces and round apertures 42*a* of the first member 42 were covered with the second member 43 formed of epoxy resin, whereafter the resin was hardened and formed into a sheet having a total thickness of 70 μm. Thereafter, as shown in FIG. 3C, an ink repelling agent was applied to one surface of the second member 43 to thereby form an ink repelling layer 46, and a layer of an adhesive agent 44 comprising cationic polymerization type epoxy resin was formed to a thickness of 2 μm on the other surface of the second member 43, and was made into B stage and hardened and contracted by the application of ultraviolet rays thereto while the tackiness thereof was kept, thereby forming an orifice plate precursor.

Figure 3D:
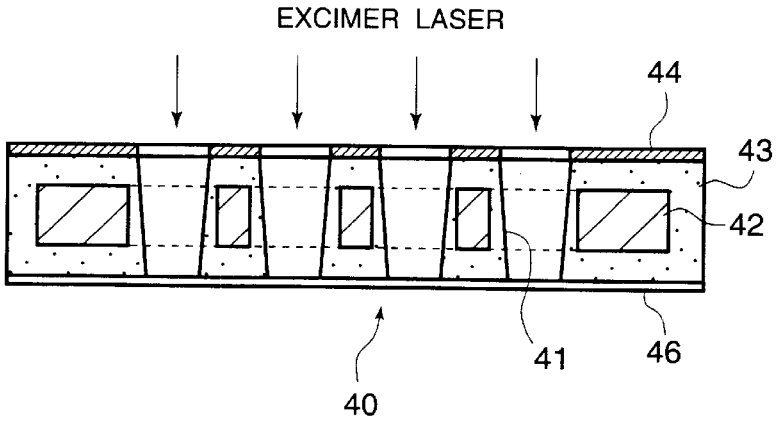

Lastly, as shown in FIG. 3D, a KrF excimer laser beam of a wavelength 248 nm was applied to the thus formed orifice plate precursor, aiming at the round apertures 42*a* of the first member 42 from the adhesive agent 44 layer side, thereby effecting the formation of the discharge ports 41.

The orifice plate 40 was formed by the above-described steps. The ink repelling layer 46 is in some cases not sufficient in its close contact property with respect to a metal and therefore, the second member 43 can be considered to perform also the function of a resin layer as the close contacting layer of the ink repelling layer 46 with respect to the first member 42.

Then, the alignment of the discharge ports 41 of the thus formed orifice plate 40 with the flow paths 401 in the joined surface 403 of the head body was effected, and that surface of the orifice plate 40 to which the adhesive agent 44 was applied was joined to the head body. Thereafter, a load of about 1 kg/cm$^2$ was applied from the discharge port surface of the liquid discharge head to thereby bring the orifice plate 40 into close contact with the head body, and the orifice plate was heated at 120° C. and pressed with that state maintained, whereby the hardening of the adhesive agent 44 was terminated.

According to the present embodiment, even if the orifice plate was heated up to 120° C., the orifice plate could be stably joined to the head body without the positional deviation of the flow paths 401 and the discharge ports 41 and any change in the pitch of the discharge ports 41 being caused. Also, when printing was effected by the use of the liquid discharge head in which the hardening of the adhesive agent 44 was terminated, a good print was obtained without the orifice plate 40 being distorted or peeled by the temperature rise during the printing.

As the adhesive agent 44, use can be made of one comprising resin made into B stage by the application of ultraviolet rays, the application of infrared rays or the heating process, or one comprising epoxy resin having at least one of the thermosetting property and the light energy hardening property.

(Second Embodiment)

Figure 5:
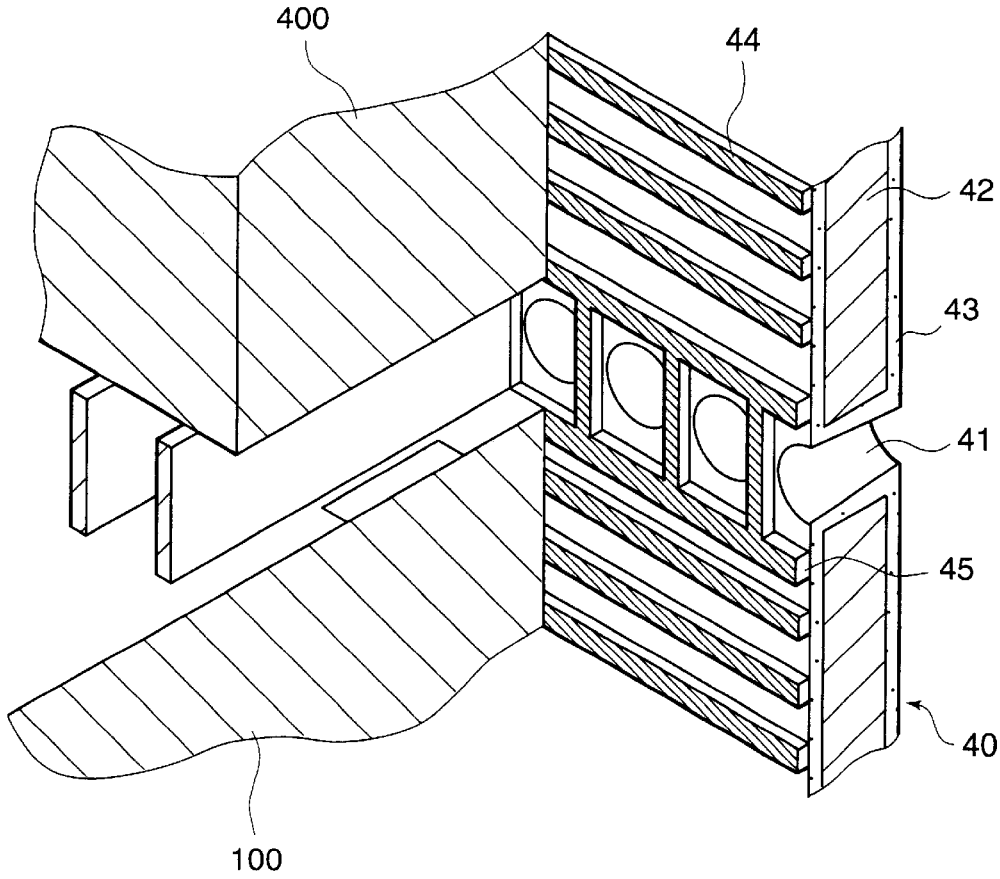
FIG. 5 is a partly broken-away perspective view showing a second embodiment of the liquid discharge head of the present invention.
Figure 6:
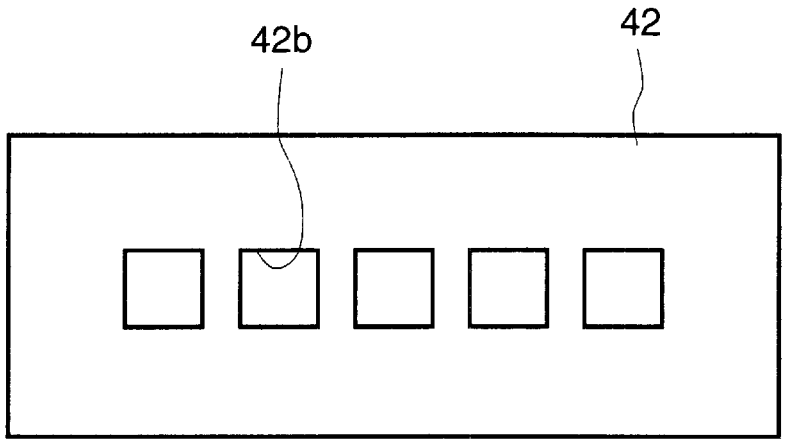
FIG. 6 is a plan view showing a first member in an orifice plate shown in FIG. 5.

FIG. 5 is a partly broken-away perspective view showing a second embodiment of the liquid discharge head of the present invention. FIG. 6 is a plan view showing a first member in an orifice plate shown in FIG. 5.

The orifice plate 40 in the present embodiment is provided with a rubber resist wall 45 on the surface thereof joined to the head body, and an adhesive agent 44 is applied to the surface of the rubber resist wall 45.

The process of manufacturing the orifice plate 40 in the present embodiment will now be described.

In the process of manufacturing the orifice plate 40 in the present embodiment, 600 square apertures 42*b* of 35μ×55 μm having a pitch of 42.3 μm were first formed in a first member 42 comprising 42 invar having a thickness of 15 μm by etching, as shown in FIG. 6.

Next, the surfaces and square apertures 42*b* of the first member 42 were covered with a second member 43 formed of epoxy resin, whereafter the resin was hardened, and was formed into a sheet having a total thickness of 50 μm. Thereafter, an ink-repelling agent, not shown, was applied onto one surface of the second member 43, and photosensitive rubber resist having cyclized rubber as the base was applied to a thickness of 4 μm onto the other surface of the second member, and pattering was effected to thereby form a rubber resist wall 45 as a joint auxiliary member comprising an elastic member which corresponds to the wall of each ink flow path. During this patterning, a line-shaped or island-shaped pattern was disposed on the other portion of the joined surface of the head body than the vicinity of the ink flow paths. The rubber resist wall 45 is elastically deformed by a pressing force applied when the orifice plate 40 is joined to the head body, and seals the surroundings of the communication ports of the head body so as to partition them.

Thereafter, a layer of the adhesive agent 44 comprising epoxy resin was formed to a thickness of 1 $\mu$m±0.5 $\mu$m on the rubber resist wall 45, and was made into B stage and hardened and contracted by the application of ultraviolet rays while the tackiness thereof was kept, thereby forming an orifice plate precursor.

Lastly, a KrF excimer laser beam of a wavelength 248 nm was applied to the thus formed orifice plate precursor, aiming at the square apertures 42*b* of the first member 42 from the adhesive agent 44 layer side, thereby forming discharge ports 41 having a diameter of 15 $\mu$m.

The orifice plate 40 was formed by the above-described steps.

Then, the alignment of the discharge ports 41 of the thus formed orifice plate 40 with the flow paths 401 in the joined surface 403 of the head body was effected, and the orifice plate 40 was joined to the head body. Thereafter, a load of about 1 kg/cm$^2$ was applied from the discharge port surface of the liquid discharge head to thereby bring the orifice plate 40 into close contact with the head body, and the orifice plate was heated at 120° C.D and pressed with that state maintained, whereby the hardening of the adhesive agent 44 was terminated.

According to the present embodiment, the thermal expansion of the orifice plate 40 can be suppressed and in addition, the rubber resist wall 45 is elastically deformed and comes into close contact with the head body without any gap and therefore, even if the orifice plate is heated up to 120° C., the orifice plate 40 can be stably joined to the head body without the positional deviation of the flow paths 401 and the discharge ports 41 and any change in the pitch of the discharge ports 41 being caused. Further, by the provision of the rubber resist wall 45, the ink flow paths can be completely partitioned from one another and the minimum amount of the adhesive agent 44 necessary for joint can be controlled. Furthermore, it has become possible to uniformly contact with the minute step and waviness of the head body side without increasing the amount of the adhesive agent.

Also, when printing was effected by the use of the liquid discharge head in which he hardening of the adhesive agent 44 was terminated, the orifice plate 40 was not distorted or peeled by the temperature rise during the printing, and there was obtained a good print high in the shooting accuracy of discharged liquid droplets.

In both of the first embodiment and the present embodiment, epoxy resin was used as the second member 43. However, the material used as the second member 43 is not restricted thereto, but may be any resin which can fill the apertures of the first member 42 and can be formed with the discharge ports 41 and is not deteriorated by the ink. Polyimide, polyamide, etc. may be mentioned as such materials.

(Third Embodiment)

Figure 7:
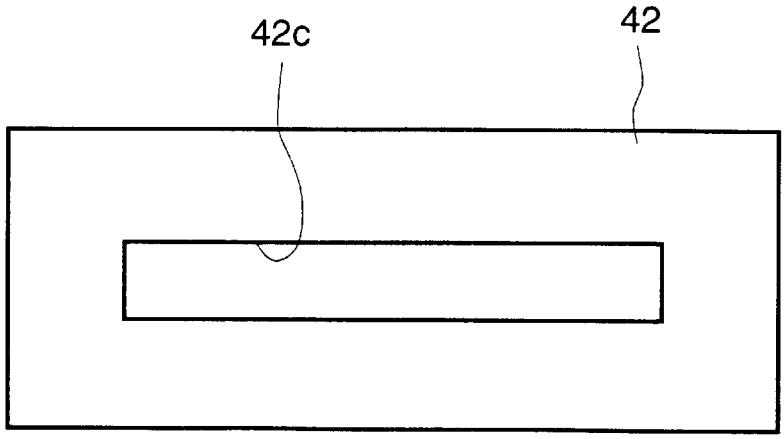
FIG. 7 is a plan view showing a first member in an orifice plate in a third embodiment of the liquid discharge head of the present invention.

FIG. 7 is a plan view showing a first member in an orifice plate in a third embodiment of the liquid discharge head of the present invention.

When it is necessary to make the arrangement pitch of discharge ports 41 finer than in the previous embodiments, it gradually becomes difficult to form apertures in a first member 42. So, as shown in FIG. 7, a slit-like slot 42*c* may be formed in the first member 42 by press, etching, a laser or electroforming, and this slot 42*c*, together with the first member 42, may be covered with a second member, whereafter a laser beam may be applied aiming at the slot 42*c* and the discharge ports 41 may be formed to thereby form an orifice plate.

Thereby, there can be formed an orifice plate in which the arrangement density is minute from 1200 dpi to 2400 dip while performance similar to that of the orifice plate in each of the above-described embodiments is maintained.

(Fourth Embodiment)

Figure 8A:
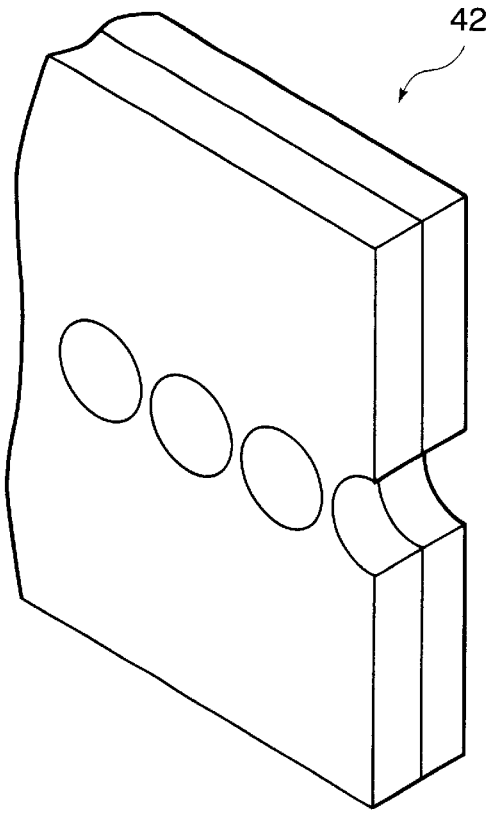
FIGS. 8A and 8B are perspective views showing a first member in an orifice plate in a fourth embodiment of the liquid discharge head of the present invention.
Figure 8B:
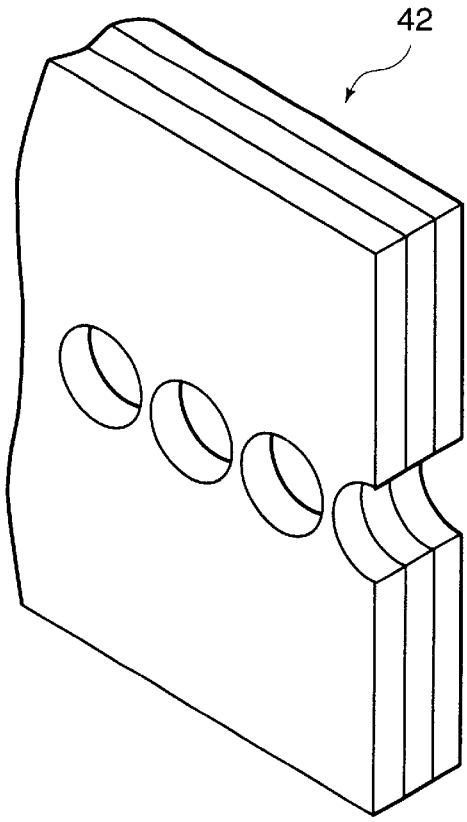

FIGS. 8A and 8B are perspective views showing a first embodiment in an orifice plate in a fourth embodiment of the liquid discharge head of the present invention.

A working method such as press, etching, a laser or electroforming is used when a first member 42 is to be formed. However, by any of these working methods, it is difficult to form apertures of a very small diameter in the first member 42 having a certain constant thickness. Therefore, it is difficult to make the diameter of the apertures small and achieve the higher density of discharge ports.

So, as shown in FIGS. 8A and 8B, a plurality of relatively thin plate materials formed with apertures at predetermined positions are stacked to construct a first member 42, whereby there can be obtained a first member 42 formed with apertures of a very small diameter and having a predetermined thickness. FIG. 8A shows a case where two plate materials are stacked, and FIG. 8B shows a case where three plate materials are stacked.

In any of these cases, an adhesive agent is used for the stacking of the plate materials. It is preferable that the adhesive agent used at this time be a material similar to the second member. Thereby, even if clogging is caused by the adhesive agent when the plate materials are stacked, this clogging is opened by the step of forming the discharge ports 41 and therefore poses no problem, and there is formed an orifice plate having a construction and a function similar to those of the previous embodiments.

(Fifth Embodiment)

FIGS. 9A to 9D are cross-sectional views showing the process of manufacturing an orifice plate in a fifth embodiment of the liquid discharge head of the present invention.

Figure 9A:
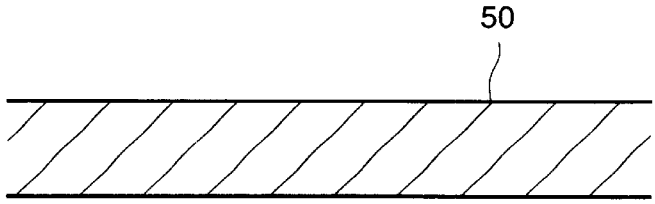
FIGS. 9A, 9B, 9C and 9D are cross-sectional views showing the process of manufacturing an orifice plate in a fifth embodiment of the liquid discharge head of the present invention.

In the process of manufacturing the orifice plate 40 in the present embodiment, as shown in FIG. 9A, a base plate (not shown) made of stainless steel to which a parting agent was applied in advance so that the thickness thereof might be 50 $\mu$m was first coated with liquid cationic polymerization type epoxy resin 50 as resin providing the base of the orifice plate 40.

Figure 9B:
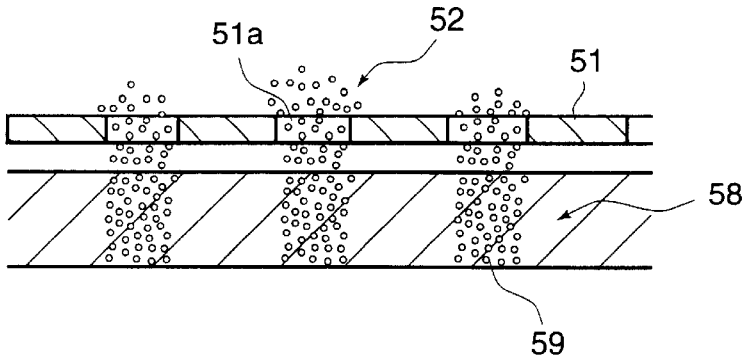
Figure 9C:
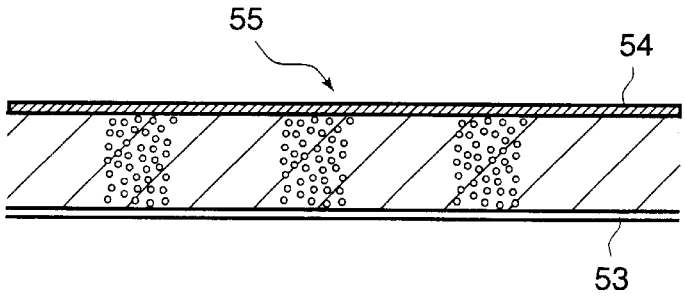

Next, as shown in FIG. 9B, an etching mask 51 of stainless steel having its portions corresponding to the reinforced areas 59 of the orifice plate 40 opened is disposed at an interval of several tens of microns from the surface of the epoxy resin 50, and fine particles 52 of aluminum oxide ($Al_2O_3$) having a particle diameter of several microns which provide a reinforcing member for the orifice plate 40 are dropped and precipitated from the opening portions 51*a* of the etching mask 51 onto the resin.

Thereafter, the base plate coated with the epoxy resin 50 is heat-processed and the epoxy resin 50 is peeled off from the base plate. Subsequently, an ink-repelling agent was applied onto one surface of the epoxy resin 50 to thereby form an ink repelling layer 53, and a layer of an adhesive agent 54 comprising cationic polymerization type epoxy resin was formed to a thickness of 2 $\mu$m on the other surface of the epoxy resin 50, and was made into B stage and hardened and contracted by the application of ultraviolet rays while the tackiness thereof was maintained, thereby forming an orifice plate precursor 55.

If the unevenness by the reinforcing member is created on the surface of the base plate when the base plate coated with the epoxy resin 50 was heat-processed, that surface may be further coated with epoxy resin or may be polished and flattened. The reinforcing member is not restricted to the above-mentioned alumina, but use may be made of fine powder of silicon carbide (SiC) silicon nitride (SiN), aluminum nitride (AlN) or zirconium oxide ($ZrO_2$) which is small in coefficient of linear expansion.

Figure 9D:
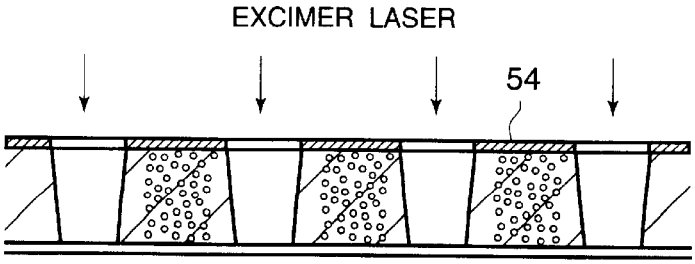
Figure 10:
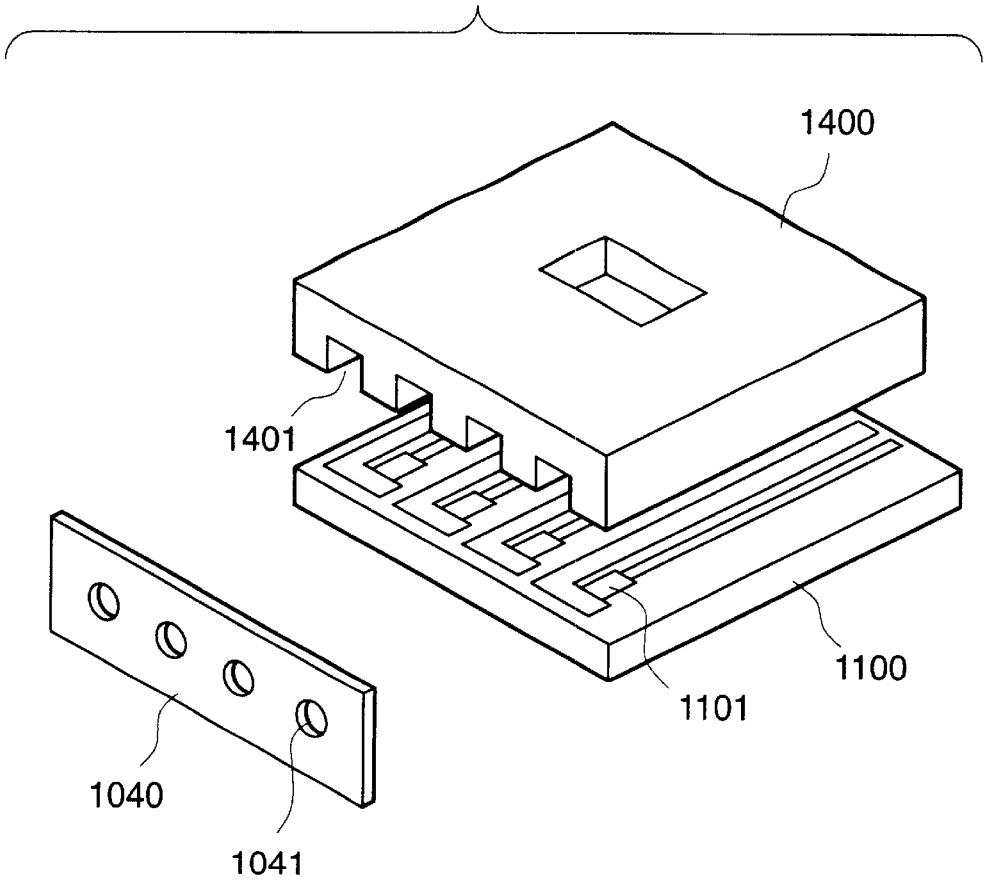
FIG. 10 is an exploded perspective view showing a liquid discharge head according to the prior art.
Figure 11:
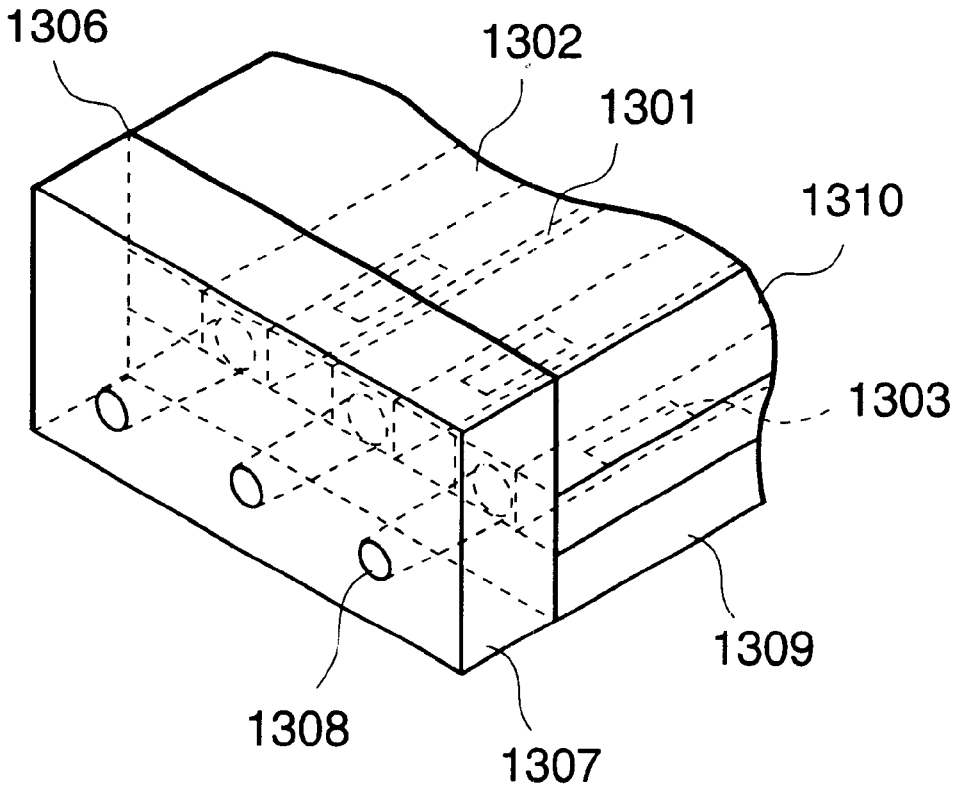
FIG. 11 is a perspective view showing another example of the liquid discharge head according to the prior art.
Figure 12:
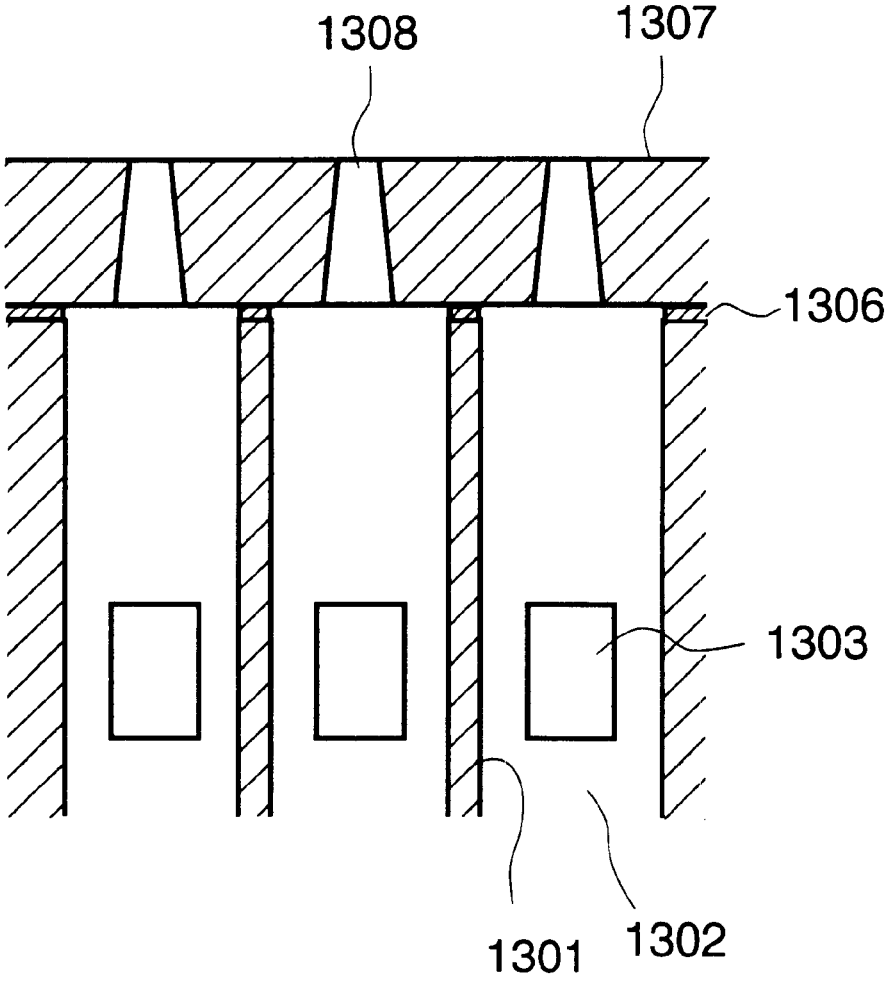
FIG. 12 is a plan cross-sectional view of the liquid discharge head shown in FIG. 11.

Lastly, as shown in FIG. 9D, a KrF excimer laser beam of a wavelength 248 nm was applied to the orifice plate precursor 55 formed as described above, aiming at discharge port forming areas 58 from the adhesive agent 54 layer side, thereby forming discharge ports.

The orifice plate 40 was formed by the above-described steps.

Then, the alignment of the discharge ports 41 of the thus formed orifice plate 40 with the flow paths 401 in the joined surface 403 of the head body was effected, and that surface of the orifice plate 40 to which the adhesive agent 44 was applied was joined to the head body. Thereafter, a load of about 1 kg/cm$^2$ was applied from the discharge port surface of the liquid discharge head to thereby bring the orifice plate 40 into close contact with the head body, and the orifice plate was heated at 120° C. and pressed with that state maintained, whereby the hardening of the adhesive agent 44 was terminated.

According to the present embodiment, even if the orifice plate was heated up to 120° C., the orifice plate 40 could be stably joined to the head body without the positional deviation of the flow paths 401 and the discharge ports 41 and any change in the pitch of the discharge ports 41 being caused. Also, when printing was effected by the use of the liquid discharge head in which the hardening of the adhesive agent 44 was terminated, a good print was obtained without the orifice plate 40 being distorted or peeled by the temperature rise during the printing.

As the adhesive agent 44, use can be made of one comprising resin made into B stage by the application of ultraviolet rays, the application of infrared rays or the heating process, or one comprising epoxy resin having at least one of the thermosetting property and the light energy hardening property.

As described above, according to the present invention, the orifice plate comprises a first member which is formed with apertures larger than the discharge ports at locations whereat the discharge ports are formed and provides the core of the orifice plate, and a second member covering the both surfaces and apertures of the first member and therefore, it becomes possible to lower the coefficient of linear expansion of the orifice plate and enhance the mechanical strength of the orifice plate by the first member, and enhance the ink resisting property of the orifice plate by the second member and thus, the possibility of the distortion or peeling of the orifice plate by the thermal expansion thereof can be reduced and the corrosion by the ink can be prevented, and the reliability of the liquid discharge head can be improved.

What is claimed is:

1. A liquid discharge head having a head body provided with an orifice plate having a plurality of discharge ports for discharging liquid droplets therefrom, a plurality of flow paths communicating with respective ones of said plurality of discharge ports, a liquid chamber for supplying liquid to said plurality of flow paths, and a plurality of energy generating elements disposed correspondingly to said plurality of flow paths and generating energy for discharging said liquid droplets, said orifice plate being joined to the joined surface of said head body in which the communication ports of said flow paths communicating with said discharge ports of said orifice plate are disposed, characterized in that said orifice plate comprises a first member providing a core of said orifice plate and formed with apertures larger than said discharge ports at locations whereat said discharge ports are formed, and a second member covering both surfaces of said first member and inner surfaces of said apertures.

2. A liquid discharge head according to claim 1, wherein a coefficient of linear expansion of said first member is substantially equal to the coefficient of linear expansion of said head body.

3. A liquid discharge head according to claim 2, wherein the coefficient of linear expansion of said first member and the coefficient of linear expansion of said second member are equal to each other or the coefficient of linear expansion of said first member is smaller than the coefficient of linear expansion of said second member.

4. A liquid discharge head according to claim 3, wherein said first member and said second member are equal in at least one of elastic modulus and Young's modulus or said first member is higher in at least one of elastic modulus and Young's modulus than said second member.

5. A liquid discharge head according to claim 4, wherein said first member is formed of a metal and said second member is formed of resin.

6. A liquid discharge head according to claim 5, wherein said discharge ports are formed by perforating said second member aiming at said apertures of said first member relative to an orifice plate precursor in which the both surfaces of said first member are covered with said second member and said apertures of said first member are filled with said second member.

7. A liquid discharge head according to claim 6, wherein said apertures of said first member are formed by one of etching, press working, laser working and electroforming.

8. A liquid discharge head according to claim 5, wherein said apertures of said first member are formed by one of etching, press working, laser working and electroforming.

9. A liquid discharge head according to claim 4, wherein said discharge ports are formed by perforating said second member aiming at said apertures of said first member relative to an orifice plate precursor in which the both surfaces of said first member are covered with said second member and said apertures of said first member are filled with said second member.

10. A liquid discharge head according to claim 9, wherein said apertures of said first member are formed by one of etching, press working, laser working and electroforming.

11. A liquid discharge head according to claim 4, wherein said apertures of said first member are formed by one of etching, press working, laser working and electroforming.

12. A liquid discharge head according to claim 3, wherein said first member is formed of a metal and said second member is formed of resin.

13. A liquid discharge head according to claim 12, wherein said discharge ports are formed by perforating said second member aiming at said apertures of said first member relative to an orifice plate precursor in which the both surfaces of said first member are covered with said second member and said apertures of said first member are filled with said second member.

14. A liquid discharge head according to claim 13, wherein said apertures of said first member are formed by one of etching, press working, laser working and electroforming.

15. A liquid discharge head according to claim 12, wherein said apertures of said first member are formed by one of etching, press working, laser working and electroforming.

16. A liquid discharge head according to claim 3, wherein said discharge ports are formed by perforating said second member aiming at said apertures of said first member relative to an orifice plate precursor in which the both surfaces of said first member are covered with said second member and said apertures of said first member are filled with said second member.

17. A liquid discharge head according to claim 16, wherein said apertures of said first member are formed by one of etching, press working, laser working and electroforming.

18. A liquid discharge head according to claim 3, wherein said apertures of said first member are formed by one of etching, press working, laser working and electroforming.

19. A liquid discharge head according to claim 2, wherein said first member and said second member are equal in at least one of elastic modulus and Young's modulus or said first member is higher in at least one of elastic modulus and Young's modulus than said second member.

20. A liquid discharge head according to claim 19, wherein said first member is formed of a metal and said second member is formed of resin.

21. A liquid discharge head according to claim 20, wherein said discharge ports are formed by perforating said second member aiming at said apertures of said first member relative to an orifice plate precursor in which the both surfaces of said first member are covered with said second member and said apertures of said first member are filled with said second member.

22. A liquid discharge head according to claim 21, wherein said apertures of said first member are formed by one of etching, press working, laser working and electroforming.

23. A liquid discharge head according to claim 20, wherein said apertures of said first member are formed by one of etching, press working, laser working and electroforming.

24. A liquid discharge head according to claim 19, wherein said discharge ports are formed by perforating said second member aiming at said apertures of said first member relative to an orifice plate precursor in which the both surfaces of said first member are covered with said second member and said apertures of said first member are filled with said second member.

25. A liquid discharge head according to claim 24, wherein said apertures of said first member are formed by one of etching, press working, laser working and electroforming.

26. A liquid discharge head according to claim 19, wherein said apertures of said first member are formed by one of etching, press working, laser working and electroforming.

27. A liquid discharge head according to claim 2, wherein said first member is formed of a metal and said second member is formed of resin.

28. A liquid discharge head according to claim 27, wherein said discharge ports are formed by perforating said second member aiming at said apertures of said first member relative to an orifice plate precursor in which the both surfaces of said first member are covered with said second member and said apertures of said first member are filled with said second member.

29. A liquid discharge head according to claim 28, wherein said apertures of said first member are formed by one of etching, press working, laser working and electroforming.

30. A liquid discharge head according to claim 27, wherein said apertures of said first member are formed by one of etching, press working, laser working and electroforming.

31. A liquid discharge head according to claim 2, wherein said discharge ports are formed by perforating said second member aiming at said apertures of said first member relative to an orifice plate precursor in which the both surfaces of said first member are covered with said second member and said apertures of said first member are filled with said second member.

32. A liquid discharge head according to claim 31, wherein said apertures of said first member are formed by one of etching, press working, laser working and electroforming.

33. A liquid discharge head according to claim 1, wherein said first member is formed of a metal and said second member is formed of resin.

34. A liquid discharge head according to claim 33, wherein said discharge ports are formed by perforating said second member aiming at said apertures of said first member relative to an orifice plate precursor in which the both surfaces of said first member are covered with said second member and said apertures of said first member are filled with said second member.

35. A liquid discharge head according to claim 34, wherein said apertures of said first member are formed by one of etching, press working, laser working and electroforming.

36. A liquid discharge head according to claim 33, wherein said apertures of said first member are formed by one of etching, press working, laser working and electroforming.

37. A liquid discharge head according to claim 1, wherein said discharge ports are formed by perforating said second member aiming at said apertures of said first member relative to an orifice plate precursor in which the both surfaces of said first member are covered with said second member and said apertures of said first member are filled with said second member.

38. A liquid discharge head according to claim 37, wherein said apertures of said first member are formed by one of etching, press working, laser working and electroforming.

39. A liquid discharge head according to claim 1, wherein said apertures of said first member are formed by one of etching, press working, laser working and electroforming.

40. A liquid discharge head according to claim 2, wherein said apertures of said first member are formed by one of etching, press working, laser working and electroforming.

41. A liquid discharge head according to claim 1, wherein said first member is constructed by a plurality of plate materials formed with said apertures being stacked one upon another.

42. A liquid discharge head according to claim 41, wherein said orifice plate and said head body are joined together by an adhesive agent.

43. A liquid discharge head according to claim 42, wherein said adhesive agent comprises resin made into B stage by the application of ultraviolet rays, the application of infrared rays or the heating process.

44. A liquid discharge head according to claim 43, wherein an adhesive agent layer comprising said adhesive agent is formed on that surface of said orifice plate which is joined to said head body.

45. A liquid discharge head according to claim 44, wherein an ink repelling layer is formed on that surface of said orifice plate which is opposite to the surface thereof joined to said head body.

46. A liquid discharge head according to claim 43, wherein a joint auxiliary member deformable by the joining of said orifice plate and said head body to seal surroundings of said communication ports is provided between said orifice plate and an end surface of said head body.

47. A liquid discharge head according to claim 46, wherein an ink repelling layer is formed on that surface of said orifice plate which is opposite to the surface thereof joined to said head body.

48. A liquid discharge head according to claim 43, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

49. A liquid discharge head according to claim 48, wherein an ink repelling layer is formed on that surface of said orifice plate which is opposite to the surface thereof joined to said head body.

50. A liquid discharge head according to claim 43, wherein an ink repelling layer is formed on that surface of said orifice plate which is opposite to the surface thereof joined to said head body.

51. A liquid discharge head according to claim 42, wherein said adhesive agent comprises epoxy resin having at least one of the thermosetting property and the light energy hardening property.

52. A liquid discharge head according to claim 51, wherein an adhesive agent layer comprising said adhesive agent is formed on that surface of said orifice plate which is joined to said head body.

53. A liquid discharge head according to claim 52, wherein an ink repelling layer is formed on that surface of said orifice plate which is opposite to the surface thereof joined to said head body.

54. A liquid discharge head according to claim 51, wherein a joint auxiliary member deformable by the joining of said orifice plate and said head body to seal surroundings of said communication ports is provided between said orifice plate and an end surface of said head body.

55. A liquid discharge head according to claim 54, wherein an ink repelling layer is formed on that surface of said orifice plate which is opposite to the surface thereof joined to said head body.

56. A liquid discharge head according to claim 51, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

57. A liquid discharge head according to claim 56, wherein an ink repelling layer is formed on that surface of said orifice plate which is opposite to the surface thereof joined to said head body.

58. A liquid discharge head according to claim 51, wherein an ink repelling layer is formed on that surface of said orifice plate which is opposite to the surface thereof joined to said head body.

59. A liquid discharge head according to claim 42, wherein an adhesive agent layer comprising said adhesive agent is formed on that surface of said orifice plate which is joined to said head body.

60. A liquid discharge head according to claim 59, wherein an ink repelling layer is formed on that surface of said orifice plate which is opposite to the surface thereof joined to said head body.

61. A liquid discharge head according to claim 42, wherein a joint auxiliary member deformable by the joining of said orifice plate and said head body to seal surroundings of said communication ports is provided between said orifice plate and an end surface of said head body.

62. A liquid discharge head according to claim 61, wherein an ink repelling layer is formed on that surface of said orifice plate which is opposite to the surface thereof joined to said head body.

63. A liquid discharge head according to claim 42, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

64. A liquid discharge head according to claim 63, wherein an ink repelling layer is formed on that surface of said orifice plate which is opposite to the surface thereof joined to said head body.

65. A liquid discharge head according to claim 42, wherein an ink repelling layer is formed on that surface of said orifice plate which is opposite to the surface thereof joined to said head body.

66. A liquid discharge head according to claim 41, wherein a joint auxiliary member deformable by the joining of said orifice plate and said head body to seal surroundings of said communication ports is provided between said orifice plate and an end surface of said head body.

67. A liquid discharge head according to claim 66, wherein an ink repelling layer is formed on that surface of said orifice plate which is opposite to the surface thereof joined to said head body.

68. A liquid discharge head according to claim 41, wherein an ink repelling layer is formed on that surface of said orifice plate which is opposite to the surface thereof joined to said head body.

69. A liquid discharge head having a head body provided with an orifice plate having a plurality of discharge ports for discharging liquid droplets therefrom, a plurality of flow paths communicating with respective ones of said plurality of discharge ports, a liquid chamber for supplying liquid to said plurality of flow paths, and a plurality of energy generating elements disposed correspondingly to said plurality of flow paths and generating energy for discharging said liquid droplets, said orifice plate being joined to the joined surface of said head body in which the communication ports of said flow paths communicating with said discharge ports of said orifice plate are disposed, characterized in that said orifice plate comprises a discharge port forming area and a reinforcing area, and in said reinforcing area, the interior of said orifice plate is filled with a reinforcing member.

70. A liquid discharge head according to claim 69, wherein said orifice plate and said head body are joined together by an adhesive agent.

71. A liquid discharge head according to claim 70, wherein said adhesive agent comprises resin made into B stage by the application of ultraviolet rays, the application of infrared rays or the heating process.

72. A liquid discharge head according to claim 71, wherein an adhesive agent layer comprising said adhesive agent is formed on that surface of said orifice plate which is joined to said head body.

73. A liquid discharge head according to claim 72, wherein an ink repelling layer is formed on that surface of said orifice plate which is opposite to the surface thereof joined to said head body.

74. A liquid discharge head according to claim 71, wherein a joint auxiliary member deformable by the joining of said orifice plate and said head body to seal surroundings of said communication ports is provided between said orifice plate and an end surface of said head body.

75. A liquid discharge head according to claim 74, wherein an ink repelling layer is formed on that surface of said orifice plate which is opposite to the surface thereof joined to said head body.

76. A liquid discharge head according to claim 71, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

77. A liquid discharge head according to claim 76, wherein an ink repelling layer is formed on that surface of said orifice plate which is opposite to the surface thereof joined to said head body.

78. A liquid discharge head according to claim 71, wherein an ink repelling layer is formed on that surface of said orifice plate which is opposite to the surface thereof joined to said head body.

79. A liquid discharge head according to claim 70, wherein said adhesive agent comprises epoxy resin having at least one of the thermosetting property and the light energy hardening property.

80. A liquid discharge head according to claim 79, wherein an adhesive agent layer comprising said adhesive agent is formed on that surface of said orifice plate which is joined to said head body.

81. A liquid discharge head according to claim 80, wherein an ink repelling layer is formed on that surface of said orifice plate which is opposite to the surface thereof joined to said head body.

82. A liquid discharge head according to claim 79, wherein a joint auxiliary member deformable by the joining of said orifice plate and said head body to seal surroundings of said communication ports is provided between said orifice plate and an end surface of said head body.

83. A liquid discharge head according to claim 82, wherein an ink repelling layer is formed on that surface of said orifice plate which is opposite to the surface thereof joined to said head body.

84. A liquid discharge head according to claim 79, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

85. A liquid discharge head according to claim 84, wherein an ink repelling layer is formed on that surface of said orifice plate which is opposite to the surface thereof joined to said head body.

86. A method of manufacturing a liquid discharge head according to claim 85, having the step of forming an adhesive agent layer on that surface of said second member which is to be joined to said head body, after the step of covering the both surfaces of said first member with a second member and filling said apertures of said first member with said second member.

87. A method of manufacturing a liquid discharge head having a head body provided with an orifice plate having a plurality of discharge ports for discharging liquid droplets therefrom, a plurality of flow paths communicating with respective ones of the plurality of discharge ports, a liquid chamber for supplying liquid to the plurality of flow paths, and a plurality of energy generating elements disposed correspondingly to the plurality of flow paths and generating energy for discharging the liquid droplets, the orifice plate being joined to a joined surface of the head body in which communication ports of the flow paths communicating with the discharge ports of the orifice plate are disposed, said method comprising the step of forming the orifice plate by the steps of:

forming apertures larger than the discharge ports at locations in a first member providing a core of the orifice plate whereat the discharge ports are formed;

covering both surfaces of the first member with a second member and filling the apertures of the first member with the second member; and perforating the second member aiming at the apertures of the first member to thereby form the discharge ports.

88. A method of manufacturing a liquid discharge head according to claim 87 or 86, having the step of forming an ink repelling layer on the surface opposite to that surface of said second member which is to be joined to said head body, after the step of covering the both surfaces of said first member with a second member and filling said apertures of said first member with said second member.

89. A liquid discharge head according to claim 79, wherein an ink repelling layer is formed on that surface of said orifice plate which is opposite to the surface thereof joined to said head body.

90. A liquid discharge head according to claim 70, wherein an adhesive agent layer comprising said adhesive agent is formed on that surface of said orifice plate which is joined to said head body.

91. A liquid discharge head according to claim 90, wherein an ink repelling layer is formed on that surface of said orifice plate which is opposite to the surface thereof joined to said head body.

92. A liquid discharge head according to claim 70, wherein a joint auxiliary member deformable by the joining of said orifice plate and said head body to seal surroundings of said communication ports is provided between said orifice plate and an end surface of said head body.

93. A liquid discharge head according to claim 92, wherein an ink repelling layer is formed on that surface of said orifice plate which is opposite to the surface thereof joined to said head body.

94. A liquid discharge head according to claim 70, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

95. A liquid discharge head according to claim 94, wherein an ink repelling layer is formed on that surface of said orifice plate which is opposite to the surface thereof joined to said head body.

96. A liquid discharge head according to claim 70, wherein an ink repelling layer is formed on that surface of said orifice plate which is opposite to the surface thereof joined to said head body.

97. A liquid discharge head according to claim 69, wherein a joint auxiliary member deformable by the joining of said orifice plate and said head body to seal surroundings of said communication ports is provided between said orifice plate and an end surface of said head body.

98. A liquid discharge head according to claim 97, wherein an ink repelling layer is formed on that surface of said orifice plate which is opposite to the surface thereof joined to said head body.

99. A liquid discharge head according to claim 69, wherein an ink repelling layer is formed on that surface of said orifice plate which is opposite to the surface thereof joined to said head body.

100. A liquid discharge head according to claim 1, wherein said orifice plate and said head body are jointed together by an adhesive agent.

101. A liquid discharge head according to claim 100, wherein said adhesive agent comprises resin made into B stage by the application of ultraviolet rays, the application of infrared rays or the heating process.

102. A liquid discharge head according to claim 101, wherein an adhesive agent layer comprising said adhesive agent is formed on that surface of said orifice plate which is joined to said head body.

103. A liquid discharge head according to claim 102, wherein an ink repelling layer is formed on that surface of said orifice plate which is opposite to the surface thereof joined to said head body.

104. A liquid discharge head according to claim 101, wherein a joint auxiliary member deformable by the joining of said orifice plate and said head body to seal surroundings of said communication ports is provided between said orifice plate and an end surface of said head body.

105. A liquid discharge head according to claim 104, wherein an ink repelling layer is formed on that surface of said orifice plate which is opposite to the surface thereof joined to said head body.

106. A liquid discharge head according to claim 101, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

107. A liquid discharge head according to claim 106, wherein an ink repelling layer is formed on that surface of said orifice plate which is opposite to the surface thereof joined to said head body.

108. A liquid discharge head according to claim 101, wherein an ink repelling layer is formed on that surface of said orifice plate which is opposite to the surface thereof joined to said head body.

109. A liquid discharge head according to claim 100, wherein said adhesive agent comprises epoxy resin having at least one of the thermosetting property and the light energy hardening property.

110. A liquid discharge head according to claim 109, wherein an adhesive agent layer comprising said adhesive agent is formed on that surface of said orifice plate which is joined to said head body.

111. A liquid discharge head according to claim 110, wherein an ink repelling layer is formed on that surface of said orifice plate which is opposite to the surface thereof joined to said head body.

112. A liquid discharge head according to claim 109, wherein a joint auxiliary member deformable by the joining of said orifice plate and said head body to seal surroundings of said communication ports is provided between said orifice plate and an end surface of said head body.

113. A liquid discharge head according to claim 112, wherein an ink repelling layer is formed on that surface of said orifice plate which is opposite to the surface thereof joined to said head body.

114. A liquid discharge head according to claim 109, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

115. A liquid discharge head according to claim 114, wherein an ink repelling layer is formed on that surface of said orifice plate which is opposite to the surface thereof joined to said head body.

116. A liquid discharge head according to claim 109, wherein an ink repelling layer is formed on that surface of said orifice plate which is opposite to the surface thereof joined to said head body.

117. A liquid discharge head according to claim 100, wherein an adhesive agent layer comprising said adhesive agent is formed on that surface of said orifice plate which is joined to said head body.

118. A liquid discharge head according to claim 117, wherein an ink repelling layer is formed on that surface of said orifice plate which is opposite to the surface thereof joined to said head body.

119. A liquid discharge head according to claim 106, wherein a joint auxiliary member deformable by the joining of said orifice plate and said head body to seal surroundings of said communication ports is provided between said orifice plate and an end surface of said head body.

120. A liquid discharge head according to claim 119, wherein an ink repelling layer is formed on that surface of said orifice plate which is opposite to the surface thereof joined to said head body.

121. A liquid discharge head according to claim 100, wherein a joint auxiliary member deformable by the joining of said orifice plate and said head body to seal surroundings of said communication ports is provided between said orifice plate and an end surface of said head body, and an adhesive agent layer comprising said adhesive agent is formed on the surface of said joint auxiliary member.

122. A liquid discharge head according to claim 121, wherein an ink repelling layer is formed on that surface of said orifice plate which is opposite to the surface thereof joined to said head body.

123. A liquid discharge head according to claim 100, wherein an ink repelling layer is formed on that surface of said orifice plate which is opposite to the surface thereof joined to said head body.

124. A liquid discharge head according to claim 1, wherein a joint auxiliary member deformable by the joining of said orifice plate and said head body to seal surroundings of said communication ports is provided between said orifice plate and an end surface of said head body.

125. A liquid discharge head according to claim 124, wherein an ink repelling layer is formed on that surface of said orifice plate which is opposite to the surface thereof joined to said head body.

126. A liquid discharge head according to claim 1, wherein an ink repelling layer is formed on that surface of said orifice plate which is opposite to the surface thereof joined to said head body.

* * * * *

UNITED STATES PATENT AND TRADEMARK OFFICE

CERTIFICATE OF CORRECTION

PATENT NO. : 6,511,162 B1
DATED : January 28, 2003
INVENTOR(S) : Toshio Kashino et al.

It is certified that error appears in the above-identified patent and that said Letters Patent is hereby corrected as shown below:

Column 20,
Line 27 “claim 106,” should read -- claim 100, --.

Signed and Sealed this

Second Day of December, 2003

JAMES E. ROGAN
*Director of the United States Patent and Trademark Office*